US009054416B2

(12) United States Patent
Bradley et al.

(10) Patent No.: US 9,054,416 B2
(45) Date of Patent: Jun. 9, 2015

(54) INVERTED CONICAL SINUOUS ANTENNA ABOVE A GROUND PLANE

(75) Inventors: Richard F. Bradley, Charlottesville, VA (US); Rohit S. Gawande, Pasadena, CA (US)

(73) Assignee: Associated Universities, Inc., Washington, DC (US)

( * ) Notice: Subject to any disclaimer, the term of this patent is extended or adjusted under 35 U.S.C. 154(b) by 379 days.

(21) Appl. No.: 13/236,305

(22) Filed: Sep. 19, 2011

(65) Prior Publication Data

US 2012/0068912 A1 Mar. 22, 2012

Related U.S. Application Data

(60) Provisional application No. 61/384,418, filed on Sep. 20, 2010.

(51) Int. Cl.

| | |
|---|---|
| ***H01Q 1/36*** | (2006.01) |
| ***H01Q 9/27*** | (2006.01) |
| ***H01Q 11/10*** | (2006.01) |

(52) U.S. Cl.

CPC . *H01Q 9/27* (2013.01); *H01Q 11/10* (2013.01)

(58) Field of Classification Search

CPC ..... H01Q 11/18; H01Q 1/362; H01Q 1/36
USPC ..... 343/895, 853, 806
See application file for complete search history.

(56) References Cited

U.S. PATENT DOCUMENTS

| | | | | |
|---|---|---|---|---|
| 4,096,459 | A * | 6/1978 | Lowenhar | 333/243 |
| 4,658,262 | A * | 4/1987 | DuHamel | 343/792.5 |
| 5,455,670 | A | 10/1995 | Payne et al. | |
| 5,982,252 | A * | 11/1999 | Werlau | 333/127 |
| 6,211,839 | B1 * | 4/2001 | Campbell | 343/792.5 |
| 6,362,796 | B1 * | 3/2002 | Bohlman | 343/895 |
| 6,844,862 | B1 * | 1/2005 | Cencich et al. | 343/832 |
| 6,917,346 | B2 * | 7/2005 | Izzat et al. | 343/895 |
| 2007/0024520 | A1 * | 2/2007 | Preble | 343/895 |
| 2007/0120758 | A1 * | 5/2007 | Takahashi | 343/788 |
| 2008/0030408 | A1 * | 2/2008 | Coates et al. | 343/702 |
| 2009/0195477 | A1 * | 8/2009 | Thiam et al. | 343/893 |
| 2012/0068912 | A1 | 3/2012 | Bradley et al. | |

* cited by examiner

*Primary Examiner* — Dameon E Levi
*Assistant Examiner* — Collin Dawkins
(74) *Attorney, Agent, or Firm* — Remenick PLLC

(57) ABSTRACT

A wideband antenna is disclosed. The wideband antenna comprises an inverted cone, at least one sinuous arm coupled to the cone, and a ground plane behind the apex of the cone. The sinuous arm comprises at least two active resonators.

13 Claims, 3 Drawing Sheets

(c) 0.5λ case (a) 0.6λ case (b) 0.75λ case

INVERTED CONICAL SINUOUS ANTENNA ABOVE A GROUND PLANE

REFERENCE TO RELATED APPLICATIONS

This application claims priority to U.S. Provisional Application No. 61/384,418, filed Sep. 20, 2010, which is entitled "Inverted Conical Sinuous Antenna above a Ground Plane," and is hereby specifically and entirely incorporated by reference.

RIGHTS IN THE INVENTION

This invention was made with United States government support under Cooperative Agreement Nos. AST-0956545 and AST-0223851, between the National Science Foundation and Associated Universities, Inc., and, accordingly, the United States government has certain rights in this invention.

BACKGROUND OF THE INVENTION

1. Field of the Invention

This invention relates to the field of antennas, and more particularly to the field of wideband antennas.

2. Introduction

There is an increasing interest in wideband, low noise feeds for the next generation radio telescopes. Ultra wideband feeds are essential for sweeping over large frequency ranges, frequency agility, detection of short duration pulses, multi-frequency imaging, and simultaneous observation of several spectral lines.

Traditionally, radio telescopes make use of feed horns for illuminating the parabolic aperture because of their simplicity, ease of excitation, versatility, large gain, and preferred overall performance. Feed horn bandwidths are limited to less than an octave and, hence, typically a set of feed horns operating at different frequencies is used to observe over a wideband range. A feed for parabola is situated such that its phase center coincides with the focus of the parabola. Different frequency bands can be selected by changing the feed horns. In some cases, it is important to study a scientific phenomenon by observing a source simultaneously at different frequencies. Because of the mechanical movement involved, it is not possible to achieve instantaneous wide bandwidth with traditional feed horns. Hence there is a need for a feed which will allow simultaneous multi frequency observations.

In the past, wide bandwidth feeds have been developed using log periodic structures of line resonators or elements stacked in the form of pyramids such as e.g. zig-zag elements used in the Allen Telescope Array or the trapezoidal geometry used in the Green Bank Solar Radio Burst Spectrometer (GB/SRBS). Other applications include, radar, measurement range, ultra wideband radio, and spread spectrum communications. Such a feed, however, has a phase center that varies with frequency. The Eleven Antenna developed by the Chalmers Group solves the varying phase center problem. The commercially available open boundary quadridge horn and quasi self-complementary (QSC) feed being developed at Cornell are other examples of decade bandwidth feeds.

A wideband, fixed phase center, dual polarized, low loss feed with an integrated low noise amplifier (LNA) was developed. The far field patterns of the feed-LNA integrated unit were measured including E, H, Co- and Cross-polarization over 0.5-4 GHz frequency range. The beamwidth was nearly constant and the phase center remained close to the center of the ground plane over the entire frequency range. However, it was found that overall the antenna lost the self-complementary nature in the presence of the ground plane, and hence, led to frequency dependent impedance variations.

SUMMARY

The present invention overcomes the problems and disadvantages associated with current strategies and designs and provides new systems and methods of observing over a wide bandwidth with an antenna.

One embodiment of the invention is directed to a wideband antenna. The wideband antenna comprises an inverted cone, at least one sinuous arm coupled to the cone, and a ground plane behind the apex of the cone. The sinuous arm comprises at least two active resonators.

In the preferred embodiment, the antenna further comprises a low noise amplifier (LNA) coupled to each sinuous arm of the antenna. The wide band antenna has one of either an active element or a passive element. Preferably the antenna is at least one of self-complementary, frequency independent, constant impedance, constant beamwidth, constant phase center, low cross polarization, and unidirectional. Preferably, the cone has a taper of between 20° and 55°. The distance between opposing corresponding resonator in opposing arms is preferably between 0.4λ-0.8λ.

In a preferred embodiment, there are four sinuous arms. The four sinuous arms are preferably equally spaced around the cone. Preferably, the outputs of LNAs in opposing sinuous pattern antennas are combined.

The resonators are preferably positioned between 0.15λ-0.35λ above the ground plane. The wideband antenna preferably also comprises a pair of twin lines coupled to opposing sinuous arms. Preferably, the twin lines are metal wires. The wideband antenna preferably also comprises a jig to maintain a predetermined distance between the twin lines and/or a chassis holder to mount the LNAs.

Other embodiments and advantages of the invention are set forth in part in the description, which follows, and in part, may be obvious from this description, or may be learned from the practice of the invention.

BRIEF DESCRIPTION OF THE DRAWINGS

The invention is described in greater detail by way of example only and with reference to the attached drawings, in which:

FIG. 1(*b*) illustrates a sinuous arm of a planar sinuous antenna.

FIG. 1(*c*) illustrates a four arm structure of a planar sinuous antenna.

DETAILED DESCRIPTION

As embodied and broadly described herein, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention.

The sensitivity of a radio telescope can be expressed as a $G/T_{sys}$ ratio, where G is the gain of the parabolic dish illuminated by a feed and $T_{sys}$ is the system noise temperature. Feeds exhibiting wideband, low noise behavior are highly desirable for radio telescopes like the Square Kilometer Array (SKA) and the Frequency Agile Solar Radiotelescope (FASR). It is difficult to achieve the high sensitivity required for radio astronomical observations over a very wide bandwidth using a single feed. An ideal wideband feed for radio astronomy preferably possesses a constant impedance, constant beamwidth, constant phase center, low cross polarization, and an optimal beam pattern to illuminate a parabola over a wide bandwidth. The self-complementary, frequency independent nature of the planar sinuous antenna makes it an excellent choice for broadband work. In order to eliminate back lobe response, in the preferred embodiment, a sinuous pattern is projected onto a 45° cone and a ground plane is placed directly behind the cone's apex. This approach results in a unidirectional, frequency independent pattern, but it destroys the self-complementary nature resulting in impedance variations. The phase center is confined to the ground plane region and a variation of less than 0.1λ is observed. A Low Noise Amplifier (LNA) is integrated with this feed and the measured results over 0.5-3 GHz were reported. The device can also be used to transmit data, for example in radar applications. The device can be a standalone device or a feed for a paraboloid dish antenna.

A sinuous pattern projected onto a cone, when used without any ground plane, provides higher directivity in the direction of the cone apex and keeps the self-complementary nature unperturbed. The pattern can be coupled to the cone by any method known, for example printing, attaching wires, attaching tubes, or attaching sheet metal. The front-to-back ratio depends on the cone taper. A larger taper gives a better front-to-back ratio but causes a higher phase center variation as a function of frequency. A moderate taper of 45° and a larger taper of 20° are used as two embodiments of topologies, however other tapers can be used. The back radiation in both cases can be attenuated by placing an absorber behind them. The larger the cone taper, the smaller the effect of the absorber on the $T_{sys}$.

Figure 1A:
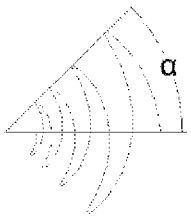
FIG. 1(*a*) illustrates a sinuous curve of a planar sinuous antenna.
Figure 1B:
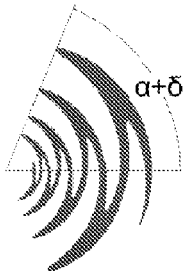
Figure 1C:
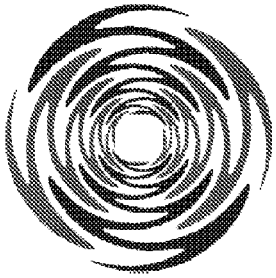

The planar sinuous antenna proposed by DuHamel (U.S. Pat. No. 4,658,262, incorporated in its entirety herein), is a frequency independent structure with constant beamwidth, fixed phase center, constant input impedance, low loss and orthogonal senses of linear polarization. As shown in FIG. 1(*a*), a sinuous curve is defined as $$\Phi = \alpha \sin\left(2\pi C \frac{\ln r - \ln r_{min}}{\ln r - \ln r_{max}}\right) \tag{1}$$

Where Φ is the polar angle, r is the radius, α is the angle subtended by the arc, and C is the number of resonators. $r_{min}$ and $r_{max}$ are inner and outer radii of the antenna respectively. One sinuous arm is formed by rotating this curve by ±δ around the origin as shown in FIG. 1(*b*). A four arm antenna structure is created by rotating a single arm though 90 degree increments to form a self-complementary antenna as shown in FIG. 1(*c*). The arm-to-ground terminal impedance for a self-complementary N-arm structure fed in mode m is frequency independent and given by $$Z_m = \frac{30\pi}{\sin\left(\frac{\pi m}{N}\right)} \tag{2}$$

where $Z_m$ is equal to 133Ω for a 4 arm structure excited in mode m=1. Voltage excitation for a normal mode is given by $$V_{n,m} = A_m^{(j360mn/N)} \tag{3}$$

where n is the arm number, r is the mode number and $A_m$ is the excitation amplitude of mode m. While four arms are used in the embodiment, any number of arms can be used. For example 2 arms or 6 arms.

Log periodic nature of the antenna is such that resonators follow a geometric progression. The ratio of radii for any two consecutive resonators is constant and defined as the expansion parameter τ. The active region of the sinuous antenna is defined where the resonator length is approximately equal to λ/2. In a four arm structure, the opposing arms are fed 180° out of phase. The charges in opposite pairs of arms flow in the same direction to form linearly polarized beams that are mutually orthogonal. The active region migrates inward from one resonator to another as the frequency of operation increases to provide a constant beamwidth. The lower frequency of operation is limited by the size of the antenna to $$\lambda_L = 4r_{max}(\alpha+\delta) \tag{4}$$

But in practice is slightly higher because of the edge effect. The abrupt termination of the antenna at the outer resonator causes a reflection from the edge, hence one or two additional resonators should be used to assure the optimum low frequency operation.

The high frequency limit is preferably set by the feed point structure. In order to provide a good transition from feed point to the active region, the smaller segment is preferably less than $\lambda_H/4$ where $\lambda_H = 8r_{min}(\alpha+\delta)$ which defines the high frequency limit. The phase center is preferably fixed in position due to symmetry of the geometry.

The planar sinuous antenna radiates in both directions. This bi-directional nature can be converted to a unidirectional antenna by adding an absorber on one side, but this reduces the gain and causes the system temperature to increase by 150 K for an ambient temperature system. A sinuous structure can be created on a cone to give a front-to-back ratio of about 10 dB. The disadvantage of this method is that the phase center moves with frequency and hence, when used with a parabolic reflector, the feed must be moved mechanically to achieve optimum performance at each frequency. The front-to-back ratio depends on the taper angle and requires a steep taper to achieve a good ratio which, in turn, makes the feed very large. A planar antenna above a ground plane can remove all of the above problems but limits the bandwidth to less than one octave.

For a self complementary antenna, the distance between opposite arms are preferably 0.4λ and the resulting cone angle from ground is preferably 51° so that each sinuous resonator is a quarter wavelength above the ground plane. The interleaving of the arms is preferably relaxed by reducing the angular width of the sinuous arms. This, in turn, increases the distance between the opposite arms and makes the antenna shorter. Three examples of successively less interleaving are presented herein, however other amounts of interleaving can be implemented. The three example embodiments, according to the distance between opposite arms, are 0.5λ, 0.6λ, and 0.75λ. Table 1 summarizes the parameters used in the three embodiments and the resulting return loss.

TABLE 1

Parameters Used for Three Embodiments

| Name | 0.5 λ | 0.6 λ | 0.75 λ |
|---|---|---|---|
| α + δ [rad] | 1 | 0.83 | 0.66 |
| cone angle [degrees] | 45 | 39.8 | 33.6 |
| $r_{max}$ [mm] | 27 | 32 | 41 |
| $r_{min}$ [mm] | 5 | 5 | 5 |
| Return loss [dB] | 4 | 7 | 10 |

Figure 2:
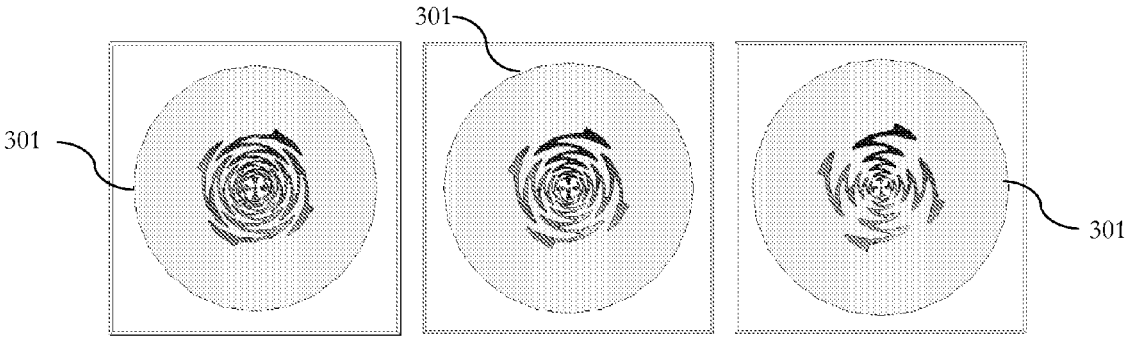
FIGS. 2(*a*)-(*c*) illustrate embodiments of sinuous antennas with different interleaving.

FIG. 2 shows the resulting structures of the three embodiments. An improvement in input return loss can be seen in the 0.75λ embodiment, as shown in Table 1. Thus, the 0.75λ embodiment, is an preferable angular width for which the input return loss is maximum.

Figure 3A:
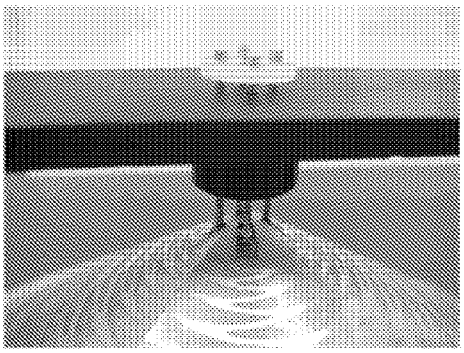
FIGS. 3(*a*)-(*b*) illustrate an embodiment of a sinuous antenna assembly.
Figure 3B:
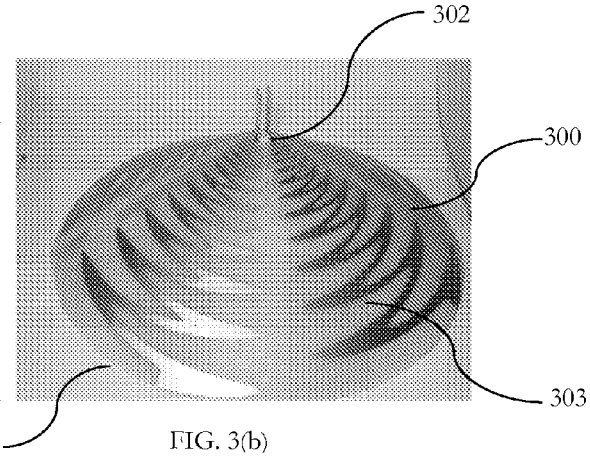

The preferred embodiment of the invention, as depicted in FIGS. 3(*a*) and 3(*b*) uses an inverted cone 300 having an apex 302 and a base 304 above a ground plane 301 (shown in FIGS. 2(*a*)-(*c*)) to obtain a unidirectional antenna. For a given frequency, a pair of λ/2 resonators 303 in the opposite arms along with their images produce a beam at boresight. The cone angle is selected such that each pair of active resonators is a quarter wavelength above the ground plane. As a result, their images are also a quarter wavelength below the ground plane and the overall phasing produces a beam at boresight. The phase center stays confined around the ground plane as a function of frequency due to the symmetry of the structure. Since the structure is defined by angles and expansion parameter τ, it follows the frequency independence principle and hence, the beam pattern is invariant over the frequency range.

An improvement in the input return loss can be achieved with a 0.75λ structure. In the preferred embodiment, the antenna is fed using a pair of twin lines, which can be, for example, two copper wires 1 mm in diameter each separated by 7 mm in air. However, any balanced or unbalanced transmission line can be used, for example, twin lines or coaxial cables. Additionally, the amplifier can be coupled directly to the feed line. In the preferred embodiment, a jig is used to maintain the distance between the wires. FIG. 3(*a*) depicts an embodiment of the jig, while FIG. 3(*b*) depicts the sinuous antenna without the ground plane.

Integration of the LNA and the feed is important to the overall performance of the receiving system. Any connectors between the feed and the LNA act as lengths of transmission lines with an impedance other than the antenna impedance. This produces a rotation and a transformation of the antenna impedance on the Smith Chart that is frequency dependent. The modified input impedance is presented to the LNA which differs from the impedance for which the LNA is designated resulting in an overall higher system noise temperature.

Figure 4:
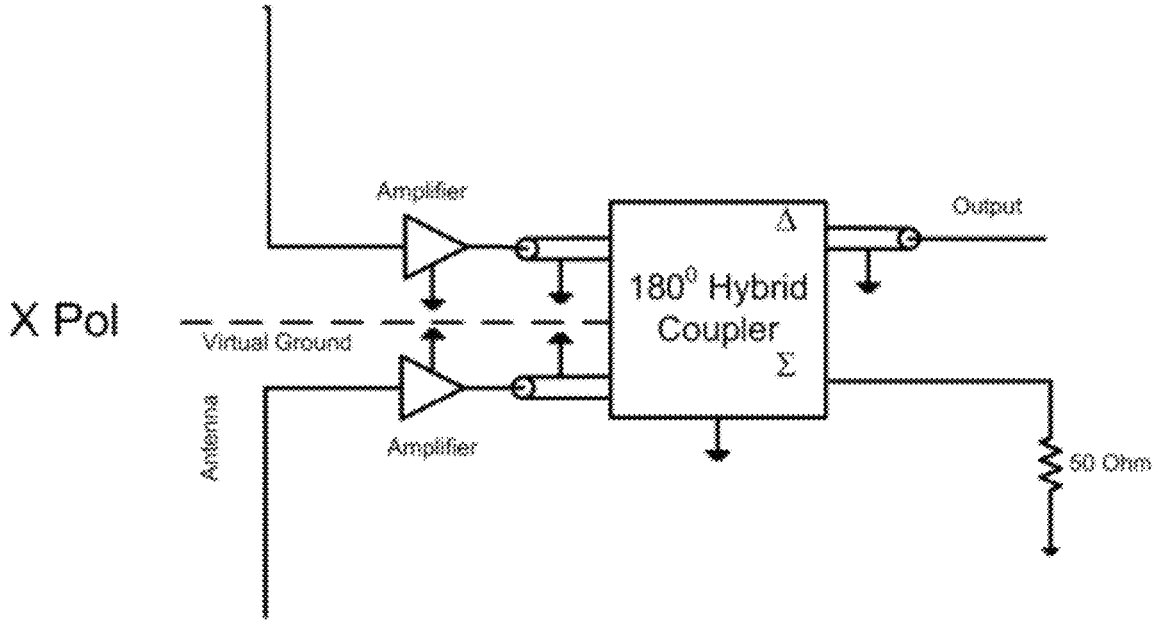
FIG. 4 illustrates an embodiment of an integrated feed-LNA configuration for the X polarization. Similar configuration is used for the Y polarization.

FIG. 4 shows a block diagram of an embodiment of a feed-LNA integration. This arrangement avoids any crossover before the LNAs. A single ended LNA is attached to each of the four arms of the feed. The outputs of the LNAs in opposing arms are combined using a commercial 180° hybrid junction at Δ ports and the Σ ports are terminated using 50Ω resistors. Although the input to this arrangement is differential, it is not a true differential amplifier. This arrangement is referred to as a pseudo differential amplifier since a low impedance, real ground is introduced at the input of the single ended amplifiers in contrast with a high impedance virtual ground in the true differential amplifier. This configuration helps to reduce undesired effects of the even mode by providing a low impedance path at the Σ port. The real ground also provides better isolation. The two pseudo differential amplifier outputs provide two linear polarizations.

Figure 5:
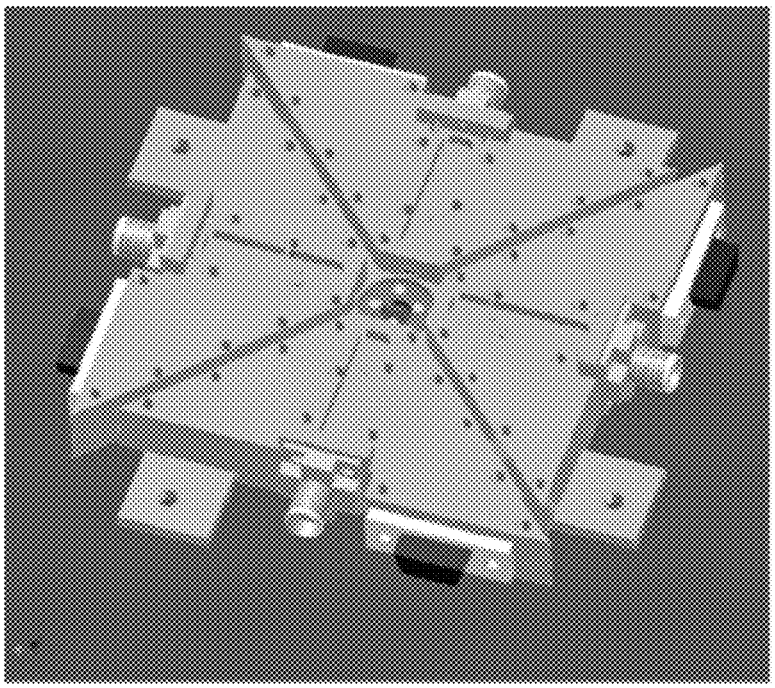
FIG. 5 illustrates an embodiment of a chassis holder.

An embodiment of a chassis holder is designed to mount four LNAs radially outwards as shown in FIG. 5. A circular G10 board with four holes on a circle and a hole in the center is mounted at the center of the holder. Four receptors are fitted in the four holes, which can accept the twin lines. In the preferred embodiment, the receptors have spring contacts which aid in assembly and disassembly of the feed and LNA. This type of unconventional assembly procedure ensures that the antenna input impedance is carried through to the transistors.

Figure 6:
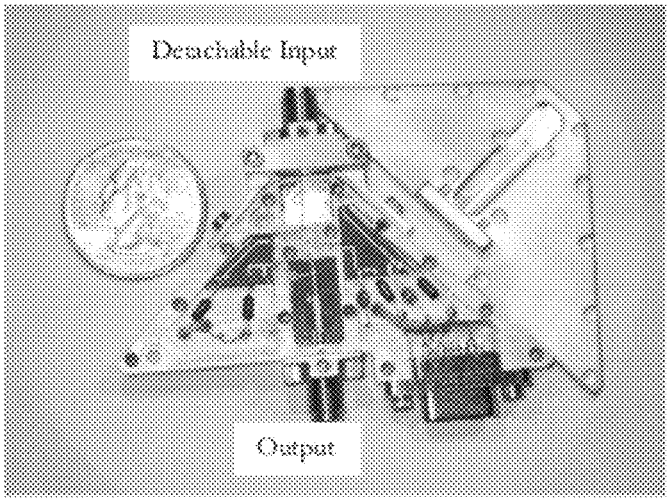
FIG. 6 illustrates an embodiment of an LNA.
Figure 7:
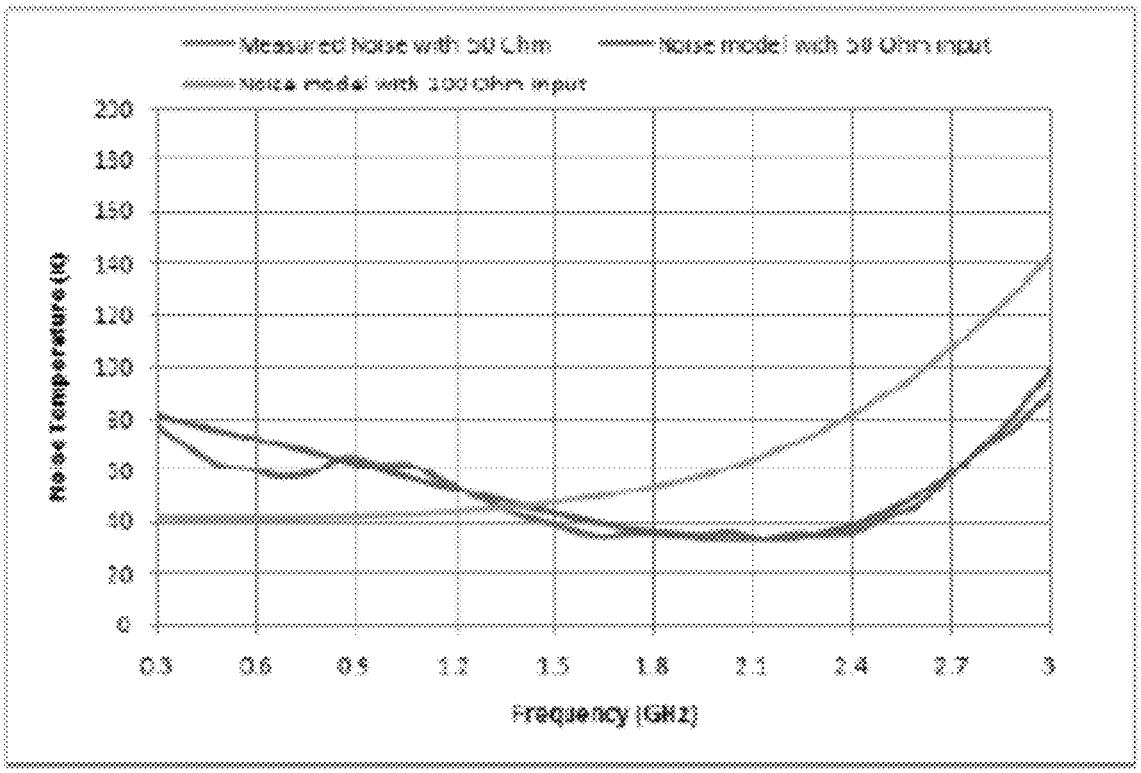
FIG. 7 illustrates the measured and modeled noise in 50Ω system. Modeled noise with 100Ω input impedance.

A low noise amplifier was developed using Eudyna FHX45X GaAs super high electron mobility transistors (HEMT) optimized for an input impedance of 100Ω. FIG. 6 is a photograph of the amplifier. A detachable input is designed for the characterization of the LNA in the 50Ω environment. FIG. 7 shows the modeled and measured noise temperature as a function of frequency.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising" includes the terms "consisting of" and "consisting essentially of," and the terms comprising, including, and containing are not intended to be limiting.

The invention claimed is:

1. A wideband antenna, comprising:

an inverted cone;

four sinuous arms coupled to the inverted cone; and a ground plane behind an apex of the inverted cone, wherein each pair of opposing sinuous arms comprising a pair of active resonators having an image, wherein each pair of active resonators and each pair of active resonators' image produce a beam directed orthogonal to the ground plane toward a base of the inverted cone, and wherein a distance between midpoints of corresponding resonators, measured in a plane parallel to the ground plane and passing through the midpoints of the corresponding resonators, in opposing arms is between 0.4λ and 0.8λ, wherein λ is a wavelength of the resonate frequency of the resonators.

2. The wideband antenna of claim 1, wherein the antenna is at least one of self-complementary, frequency independent, constant impedance, constant beamwidth, constant phase center, low cross polarization, and unidirectional.

3. The wide band antenna of claim 1, further comprising a low noise amplifier (LNA) coupled to each sinuous arm.

4. The wide band antenna of claim 3, wherein the LNA is coupled to one of an active element and an inactive element.

5. The wideband antenna of claim 3, wherein the inverted cone has a taper of between 20° and 55°.

6. The wideband antenna of claim 3, wherein the four sinuous arms are equally spaced around the inverted cone.

7. The wideband antenna of claim 6, wherein the outputs of LNAs in opposing sinuous arms are combined using a 180° hybrid junction.

8. The wideband antenna of claim 3, further comprising a chassis holder to mount the LNAs.

9. The wideband antenna of claim 1, wherein the resonators are positioned between 0.15λ and 0.35λ above the ground plane.

10. The wideband antenna of claim 1, further comprising a pair of twin lines coupled to opposing sinuous arms.

11. The wideband antenna of claim 10, wherein the twin lines are metal wires.

12. The wideband antenna of claim 10, further comprising a jig to maintain a predetermined distance between the twin lines.

13. The wideband antenna of claim 1, wherein the antenna is unidirectional.

* * * * *